United States Patent [19]

Noble

[11] 4,433,364

[45] Feb. 21, 1984

[54] LIGHTED HANDGRIP

[76] Inventor: Edward E. Noble, R.R. #1, Box 176, Edgewood Rd., Eureka, Ill. 61530

[21] Appl. No.: 22,721

[22] Filed: Mar. 21, 1979

[51] Int. Cl.[3] ..... F21V 33/00

[52] U.S. Cl. ..... 362/109; 362/119; 362/157; 362/186; 362/200; 362/208; 200/60

[58] Field of Search ..... 362/109, 119, 120, 276, 362/157, 186, 200, 205, 208; 200/60

[56] References Cited

U.S. PATENT DOCUMENTS

| | | | |
|---|---|---|---|
| 1,883,807 | 10/1932 | McIntire | 200/157 UX |
| 2,248,359 | 7/1941 | Klopfenstein | 362/119 |
| 2,515,292 | 7/1950 | Carr | 362/119 X |
| 2,854,564 | 9/1958 | Cohen et al. | 362/119 X |
| 3,100,489 | 8/1963 | Bagley | 200/157 UX |
| 3,370,163 | 2/1968 | Brill | 362/119 X |
| 3,500,293 | 3/1970 | Cocco | 362/109 X |
| 3,700,836 | 10/1972 | Rackson | 200/157 UX |

*Primary Examiner*—Peter A. Nelson

*Attorney, Agent, or Firm*—Paul H. Gallagher

[57] ABSTRACT

A pair of handles, mounted individually on the ends of a coil spring, the ends of the spring extending longitudinally into the ends of the handles, and the coil thereby being positioned beyond the handles. A light bulb and battery are included in one of the handles, and conductors, including the spring, connect the light bulb and battery in circuit, and terminate in contacts in the ends of the handles remote from the spring, and upon interengagement of the contacts, they complete the circuit and turn on the light. In squeezing the handles, in exercising the hand, illumination of the light signals the interengagement of the handles.

3 Claims, 1 Drawing Figure

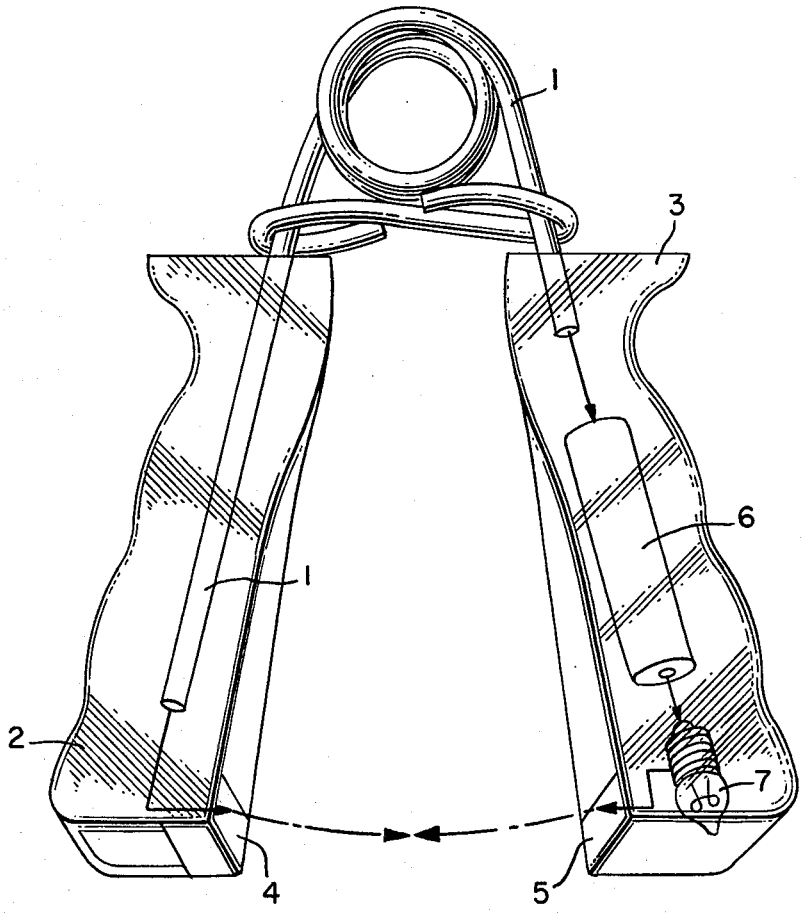
1
3
6
1
2
7
4
5

LIGHTED HANDGRIP

This invention relates to a lighted handgrip, used for physical fitness or development, which has a handle that lights up, in a manner similar to a flashlight, whenever the handgrip is fully squeezed, or squeezed tightly enough to close its electrical circuit.

In the drawing:

The single FIGURE is a perspective view of the lighted handgrip of the invention.

The purpose of this invention is to provide athletes, or individuals engaged in the development of a vice-like grip, with a handgrip that makes it easier to determine whether or not the handgrip's handles are fully together or touching. In addition, this invention will allow the handle ends to be kept fully closed, making use of the full tension capacity of the handgrip spring.

Ordinarily, when using handgrips for developing a vice-like grip, the handles must be squeezed together and then held in a closed position for as long as possible. This conditioning usually takes place over a long period of time. During this conditioning, the length of time that the handles are held together is gradually increased, while a record of improvement is usually kept. While squeezing the handgrip, it is often difficult to determine whether or not the handles are fully together and touching. For this reason, a coin is usually placed between the ends of the handles so that whenever the handles are relaxed, the coin will slip out, which serves as a signal that the handles are apart. However, there are certain disadvantages to using a coin: placing a coin between the handles, and keeping it there, is an awkward task; the coin must be retrieved each time the handles are relaxed; since one hand must be kept free, only one handgrip can be used at a time; the width of the coin prevents the handles from being fully closed, which fails to make use of the full tension capacity of the handgrip spring.

To solve all of these problems, I have designed a handgrip which has a handle that lights up, in a manner similar to a flashlight, whenever the handle ends meet. The invention is illustrated in the accompanying drawing, in which one of the handles 3 serves as a housing for a AAA-battery 6 and a flashlight bulb 7, while the handgrip spring 1 serves as a wire, or electrical conductor, connecting the battery 6 to the bulb 7. (In place of the spring, a wire, or metal stripping along the inside of each of the handles, could be used to connect the battery to the bulb. However, this method is intrinsically the same as the one described herein.) To complete the circuit, the inside surface of each of the handle ends are covered with metal contact plates 4,5 that touch, or come into contact, whenever the handgrip is fully squeezed, thus closing the circuit and lighting the bulb 7. As long as the ends of the handles 2,3 are in contact, the bulb 7 will remain lit. This, of course, indicates that the handgrip is being squeezed tightly enough.

While I can conceive of many other variations of a lighted handgrip, such as having both handles light up or locating the bulb (or bulbs) in various locations within the handle (or handles), the invention in each case would be intrinsically the same as the one described herein.

I claim:

1. A handgrip comprising, a pair of elongated handles to be gripped by the hand and of a size to be engaged by the whole hand throughout the width of the hand, means mounting the handles together for movement of the handles toward and from each other in pivotal movement about a pivot axis that is disposed longitudinally beyond the handles whereby substantially the whole body of the hand grip is disposed longitudinally beyond the pivot axis, the mounting means including spring means biasing the handles apart and yielding to enable the handles to be moved toward each other into interengagement, and the spring means being of great strength whereby the handles can be moved into such interengagement only by the full strength of the hand, the handgrip including an electrical circuit which itself includes a battery, light bulb, and contacts, one of the contacts being in each of the handles, and the contacts being exposed for interengagement in response to the handles being moved into interengagement, and effective when so interengaged for completing circuit and lighting the light bulb, the electric circuit being normally open and closed only when the handles are interengaged.

2. A handgrip according to claim 1 wherein, the contacts are disposed at the extreme end of the handles remote from the pivot axis, whereby to effect lighting of the light bulb only when the handles are in extreme and full interengagement.

3. A handgrip according to claim 1 wherein, the mounting means is constituted solely by the spring means, and the spring means is in the form of a torsion coil with linear end elements extending therefrom, the end elements extend into the handles and constitute the means by which the handles are mounted on the spring means, and the spring means constitutes a portion of the electrical circuit.

* * * * *